United States Patent [19]

Ortega

[11] 4,122,799

[45] Oct. 31, 1978

[54] PAINTING DEVICE

[76] Inventor: Antonio Ortega, 2608 SW 8th St., Apt. #11, Miami, Fla. 33135

[21] Appl. No.: 771,940

[22] Filed: Feb. 25, 1977

[51] Int. Cl.[2] ..... B05C 1/00

[52] U.S. Cl. ..... 118/207; 118/242

[58] Field of Search ..... 118/108, 207, 305, 242, 118/9; 15/246; 33/41 C

[56] References Cited

U.S. PATENT DOCUMENTS

| | | | |
|---|---|---|---|
| 443,576 | 12/1890 | Hawks | 118/242 X |
| 750,307 | 1/1904 | Russell | 118/207 |
| 2,797,427 | 7/1957 | Tate | 15/246 X |
| 3,109,755 | 11/1963 | Stanley | 118/207 X |
| 3,788,273 | 1/1974 | Tusch et al. | 118/305 X |
| 3,847,112 | 11/1974 | Wise | 118/207 X |

*Primary Examiner*—John McIntosh

[57] ABSTRACT

An expandable linear guide is releasably affixed to a wall at a desired space below a ceiling meeting the wall. A paint applying device is removably mounted on the guide for movement along the length of the guide and includes a roller in abutment with the wall. A pulley and cord arrangement is mounted on the guide and coupled to the paint applying device for moving the paint applying device along the length of the guide, as desired.

2 Claims, 5 Drawing Figures

PAINTING DEVICE

BACKGROUND OF THE INVENTION

The present invention relates to a painting device. More particularly, the invention relates to a painting device for painting a strip of wall adjacent the ceiling of a room.

Objects of the invention are to provide a painting device of simple structure, which is inexpensive in manufacture, assembled and disassembled with facility and convenience, releasably mounted on a wall with facility and convenience, utilized with facility and convenience, and functions efficiently, effectively and reliably to paint a strip of wall adjacent the ceiling of a room.

BRIEF DESCRIPTION OF THE DRAWINGS

In order that the invention may be readily carried into effect, it will now be described with reference to the accompanying drawings, wherein.

DETAILED DESCRIPTION OF THE INVENTION

The painting device of the invention functions to paint a strip of wall 1 (FIGS. 1 and 2) adjacent the ceiling 2 (FIGS. 1 and 2) of a room.

Figure 1:
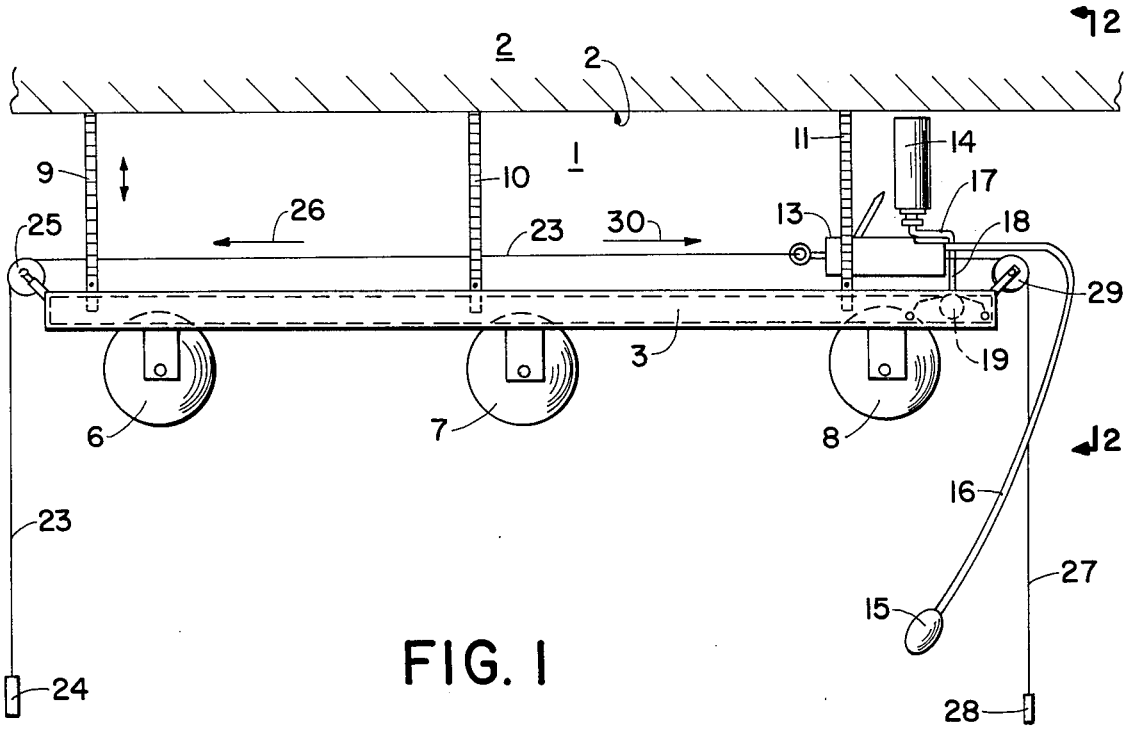
FIG. 1 is a view of an embodiment of the painting device of the invention.
Figure 2:
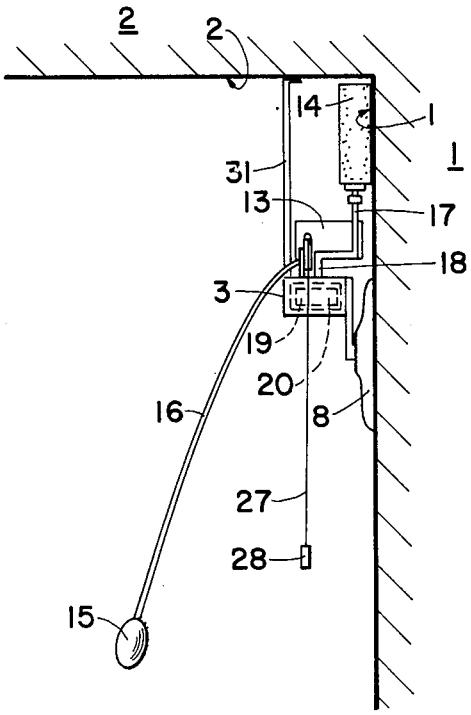
FIG. 2 is a view, taken along the lines II—II, of FIG. 1.
Figure 3:
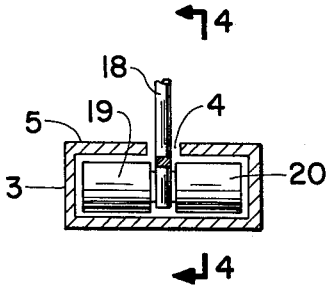
FIG. 3 is a view, partly in section, on an enlarged scale, illustrating part of the painting device of the invention.
Figure 4:
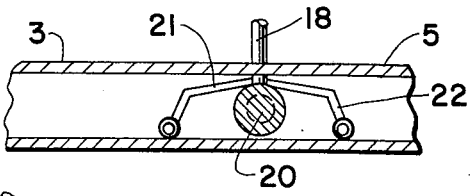
FIG. 4 is a view, partly in section, taken along the lines IV—IV, of FIG. 3.

The painting device of the invention comprises an expandable substantially linear guide device 3 (FIGS. 1 to 4). The guide device comprises a substantially tubular elongated member of rectangular cross-section having a center slot 4 extending along its length in its upper surface 5, as shown in FIG. 3. The guide device 3 preferably includes at least two telescoping sections, so that it may be extended or expanded in length.

A plurality of suction cups 6, 7 and 8 (FIG. 1) are affixed to the guide device 3 and releasably affix the guide device to the wall 1 at a desired space below the ceiling 2, which meets the wall, as shown in FIG. 1. The proper or desired position of the guide device 3 is determined by measuring the distance from the ceiling, along the wall, and may be accomplished by a plurality of measuring tapes 9, 10, and 11 (FIG. 1). Each of the measuring tapes is movably mounted on the guide device 3 for movement up and down. Preferably, each of the measuring tapes is spring-biased and housed in its own housing, mounted on the guide device, so that after the desired position of the guide device has been determined the measuring tapes are stored in their housings.

Figure 5:
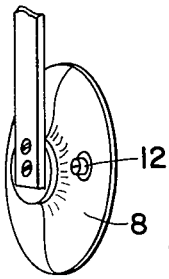
FIG. 5 is a perspective view, on an enlarged scale, of a suction cup of the painting device of the invention.

Each of the suction cups comprises any suitable type of suction cup and has a valve such as, for example, the valve 12, shown in FIG. 5, for admitting air into the cavity formed by the suction cup in order to release such suction cup. Thus, when it is desired to release the suction cup, the valve such as, for example, the valve 12 of FIG. 5, is manually rotated to admit air into the cavity of the suction cup and thereby release the pressure holding the suction cup to the wall 1.

A paint applying device includes a container 13 of paint (FIGS. 1 and 2). A paint roller 14 (FIGS. 1 and 2) is removably mounted on the paint container, a pump device 15 of any suitable type, such as, for example, a manually operated pump, functions to supply paint from the container 13 to the roller 14 via flexible tubing 16 from the pump to the container and via rigid tubing 17 from the container to the roller. The paint applying device, and more particularly, the paint container 13 thereof, is movably mounted on the guide device 3 for movement along the length of said guide device with the roller 14 in abutment with the wall 1, as shown in FIG. 2. This is accomplished by mounting the paint container 13 on a stem 18 (FIGS. 1 to 4) extending into the slot 4 of the upper surface 5 of the guide device 3. The stem 18 is mounted on a pair of rollers 19 and 20 (FIGS. 2 and 3) which roll along the inside of the guide device 3. A pair of outriggers 21 and 22 (FIG. 4) are affixed to the stem 18 above the rollers 19 and 20 in the guide device 3 to maintain said stem in vertical position.

A pulley and cord arrangement is mounted on the guide device 3 and coupled to the paint applying device, and more particularly, to the paint container 13 thereof, for moving the paint applying device as desired, along the length of the guide device. Thus, for example, a cord 23 is affixed at one end to the paint container 13 and has a handle part 24 at the opposite end thereof, as shown in FIG. 1. The cord 23 passes over a pulley 25 (FIG. 1), so that when the handle 24 is pulled, the paint applying device is moved in the direction of an arrow 26 of FIG. 1. A cord 27 is affixed at one end to the opposite end of the paint container 13 and has a handle part 28 at the opposite end thereof, as shown in FIGS. 1 and 2. The cord 27 passes over a pulley 29 (FIG. 1), so that when the handle part 28 is pulled, the paint applying device is moved in the direction of an arrow 30 of FIG. 1.

A rod 31 is affixed to the guide device 3 and extends to the ceiling 2 in order to maintain the proper distance from the ceiling, as shown in FIG. 2.

The rollers 19 and 20 are removably mounted to facilitate cleaning and replacement thereof. Thus, if a decorative effect is desired, a decorative roller may be inserted instead of a smooth surfaced roller.

While the invention has been described by means of a specific example and in a specific embodiment, I do not wish to be limited thereto, for obvious modifications will occur to those skilled in the art without departing from the spirit and scope of the invention.

I claim:

1. A painting device for painting a strip of wall adjacent the ceiling of a room, said painting device comprising expandable substantially linear guide means;

suction cup means affixed to the guide means for releasably affixing the guide means to a wall at a desired space below a ceiling meeting the wall;

paint applying means including a roller, said paint applying means being movably mounted on the guide means for movement along the length of said guide means with the roller in abutment with the wall; and pulley and cord means mounted on the guide means and coupled to the paint applying means for moving the paint applying means as desired along the length of the guide means.

2. A painting device as claimed in claim 1, wherein the paint means further includes a container of paint and pump means for supplying paint from the container to the roller.

* * * * *